US006192551B1

(12) United States Patent
Roth

(10) Patent No.: US 6,192,551 B1
(45) Date of Patent: Feb. 27, 2001

(54) WET CLEANING APPARATUS

(75) Inventor: Paul Roth, Isny (DE)

(73) Assignee: PROAIR GmbH Gerätebau (DE)

( * ) Notice: Subject to any disclaimer, the term of this patent is extended or adjusted under 35 U.S.C. 154(b) by 0 days.

(21) Appl. No.: 09/157,127

(22) Filed: Sep. 18, 1998

(30) Foreign Application Priority Data

Sep. 20, 1997 (DE) ..... 197 41 545

(51) Int. Cl.[7] ..... A47L 9/22
(52) U.S. Cl. ..... 15/413; 15/326
(58) Field of Search ..... 15/326, 413

(56) References Cited

U.S. PATENT DOCUMENTS 2,884,185 * 4/1959 Dolan ..... 15/413 X
4,280,245 * 7/1981 Hiester ..... 15/413 X
4,361,928 * 12/1982 Schulz ..... 15/413 X
4,665,581 * 5/1987 Oberdorfer ..... 15/413 X

* cited by examiner

*Primary Examiner*—Chris K. Moore
(74) *Attorney, Agent, or Firm*—Robert W. Becker & Associates

(57) ABSTRACT

A wet cleaning apparatus having at least one outlet is provided. The apparatus has an intake fitting, for a suction air stream, which opens out into a liquid container. An upper housing part is disposed on the liquid container and has disposed therein a motor about which at least part of which flows a coolant air flow. At least one turbulence chamber is provided in which the suction air stream and the coolant air flow meet one another at an angle.

32 Claims, 2 Drawing Sheets

WET CLEANING APPARATUS

BACKGROUND OF THE INVENTION

The present invention relates to a wet cleaning apparatus having a liquid container into which opens an intake fitting for a suction air stream; also provided is a housing cover portion in which is disposed a motor about at least part of which flows a coolant air flow; at least one outlet is also provided.

With such wet cleaning apparatus, air that is loaded or contaminated with dust and/or dirt particles is drawn in via the intake fitting. The air flows through the cleaning liquid, preferably water, that is present in the liquid container; the particles are retained in the cleaning liquid. The air that is freed of the dust/dirt particles flows upwardly through a separator and a blower or turbine before it is blown out through the outlet. To cool the motor, coolant air from the environment is drawn in by a rotor, for which purpose an additional opening is provided in the housing of the wet cleaning apparatus. This coolant air flow flows along the motor and cools it. The coolant air flow is blown out through a further opening. The coolant air flow and the suction air stream flow out through the respective outlets at relatively high velocities. A considerable development of noise is associated with this discharge. Since the air streams exit the wet cleaning apparatus downwardly at an angle, dust found on the floor is additionally unnecessarily raised or stirred up.

It is an object of the present invention to embody a wet cleaning apparatus of the aforementioned general type in such a way that in a structurally straightforward manner, a considerable reduction of noise during operation of the wet cleaning apparatus is achieved, whereby the danger that dust particles are raised by the exiting air streams is avoided.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

With the inventive wet cleaning apparatus, the coolant air flow and the suction air stream meet one another at an angle in the turbulence chamber. As a result, the two air flows are very greatly slowed down so that they exit out of the wet cleaning apparatus with only a low velocity. Due to the coming together of the two air flows, a resonance effect additionally occurs that leads to a considerable reduction in noise. Consequently, the wet cleaning apparatus operates with only a low development of noise. In addition, due to the turbulence, and the thereby achieved great reduction in velocity, dust particles that exist on the surface of the floor or surface that is to be cleaned, are not stirred up.

Pursuant to one specific embodiment of the inventive wet cleaning apparatus, at least the suction air stream exits upwardly at an angle into the environment. Consequently, this air stream is prevented from reaching the surface that is to be cleaned and stirring up dust/dirt particles there.

Further specific features of the present invention will be described subsequently.

DESCRIPTION OF PREFERRED EMBODIMENTS

Figure 1:
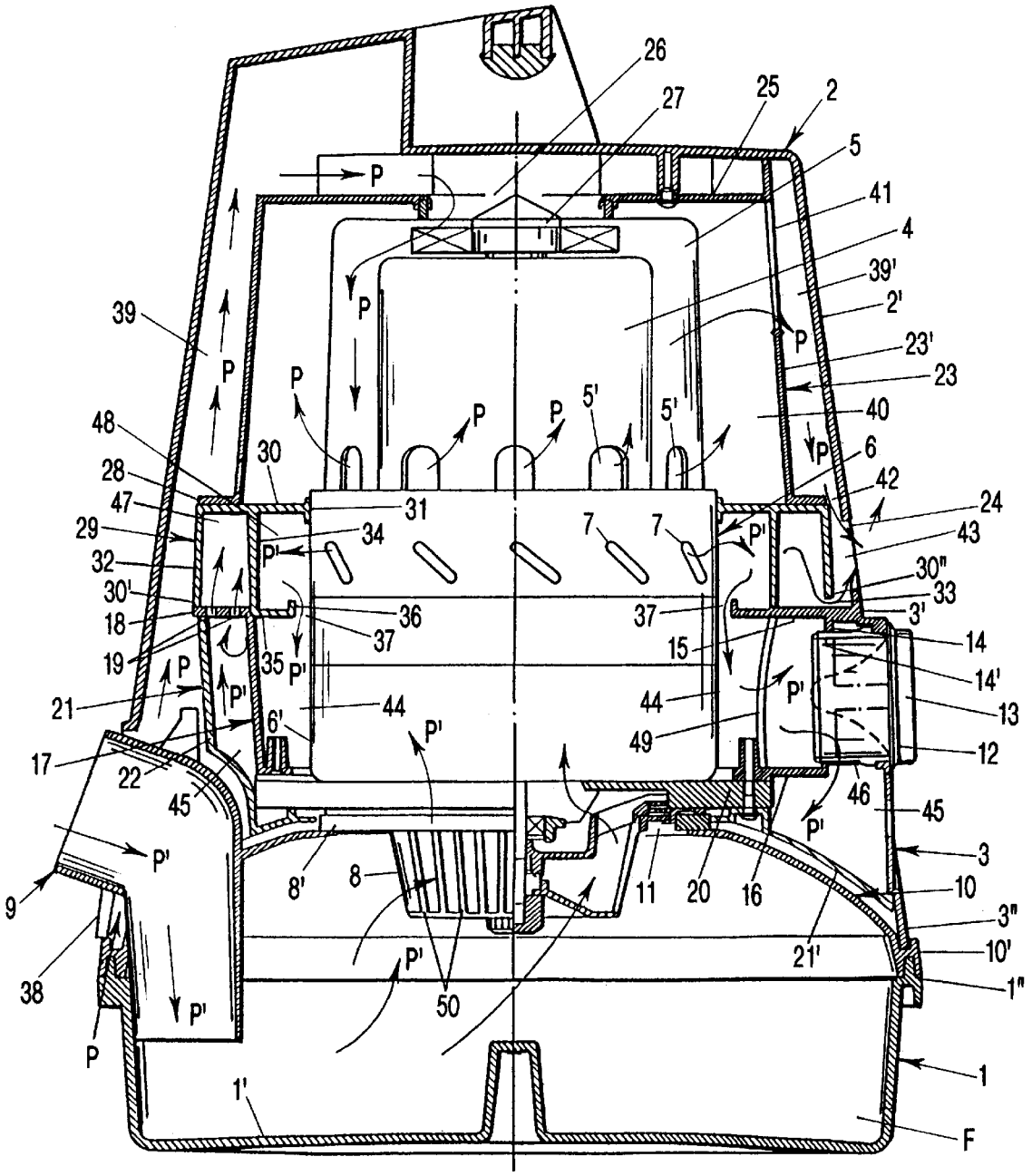
FIG. 1 is an axial cross-sectional view of one exemplary embodiment of the inventive wet cleaning apparatus with a guiding or deflecting head.
Figure 2:
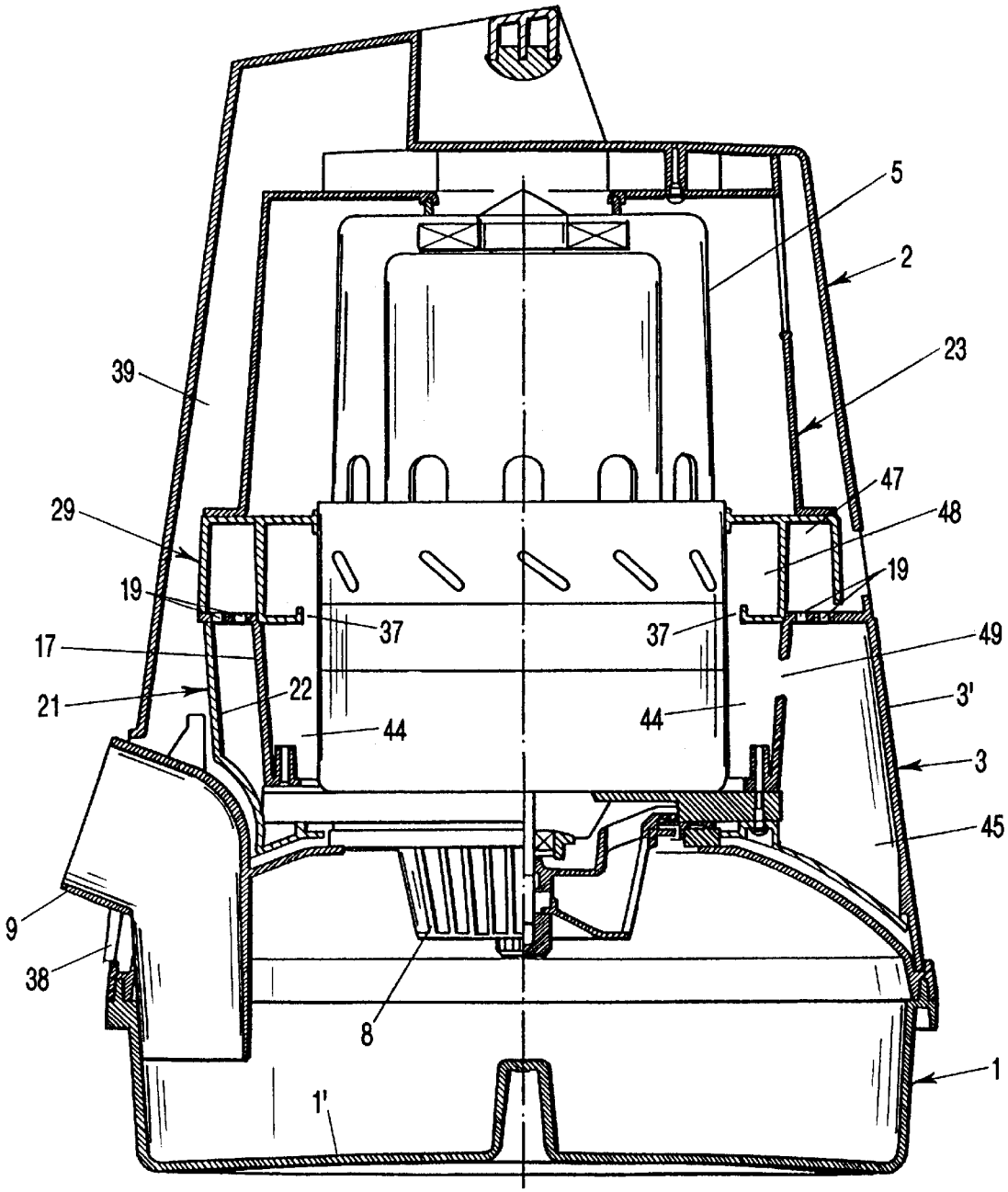
FIG. 2 is an axial cross-sectional view of the wet cleaning apparatus of FIG. 1.

Referring now to the drawings in detail, the wet cleaning apparatus illustrated in FIGS. 1 and 2 is a so-called wet vacuum cleaner that is used, for example, for cleaning floors. It has a liquid container 1 that serves as a bottom part of a housing. The liquid container 1 can sit on an undercarriage having wheels or rollers. Alternatively, it is also possible for the liquid container 1 itself to be provided with wheels or rollers. An upwardly extending upper housing part 2, 3, 29, 23 is disposed on the liquid container 1. Accommodated in the upper housing part is a motor 4 with a motor housing 5 and a turbine (fan) 6. The upper housing part 2, 3, 29, 23 comprises a connecting part 3 that sits on the liquid container 1, a middle part 29 that is disposed on the connecting part, and a top or closure part 23 that is disposed on the middle part and is covered by a cover part 2. The motor housing 5 has peripherally arranged discharge openings 5' for a motor coolant air flow P. Disposed below the motor 4 is the turbine 6, which is driven by the motor and is similarly provided with peripherally arranged discharge openings 7.

The liquid container 1 is provided with an intake fitting 9 to which can be connected a vacuum hose. The intake fitting 9 projects inwardly and downwardly into the liquid container 1, advantageously to such an extent that the discharge opening of the intake fitting 9 lies below the liquid level. The dirty air drawn in by the intake opening 9 is thereby necessarily brought into contact with the liquid F, which is preferably water.

The liquid container 1, when viewed in cross-section, has a concavely curved base 1' and a convexly curved lid 10. The connecting part 3 sits on the edge of the lid 10. The lid 10, which is integrally formed with the intake opening 9, has a circumferential rim 10' that has an approximately H-shaped cross-sectional configuration. By means of this rim 10', the lid 10 is placed upon an annular projection 1" of the liquid container 1. An edge 3" of the connecting part 3 is placed upon the H-shaped rim 10' of the lid 10.

The lid 10 is provided with a central opening 11 through which a separator 8 extends into the liquid container 1. By means of a holding ring 8', the separator 8 rests upon the rim of the opening 11 and is secured to the underside of the middle part 29 of the housing by means of an annular carrier or bracket 20. On that side located across from the intake fitting 9, the connecting part 3 has an outer wall portion 3' that is approximately aligned with an outer wall 2' of the cover part 2. The wall 3' has an opening 12 in which is disposed a guiding or deflecting head 13 (FIG. 1). The guiding or deflecting head 13 projects into the connecting part 3 through an opening 14' of an axially extending wall 14 that is provided bet ween radially extending walls 15 and 16. A wall 17 that extends at an angle slightly conically inwardly is disposed across from the wall 14 on the side of the intake fitting 9; the wall 17 has an upper, radially outwardly projecting flange 18. The flange 18 is provided with a plurality of apertures 19 for the suction air stream P'; the apertures 19 are peripherally arranged so as to be radially spaced from one another and are disposed next to and after one another. The wall 17 merges into the wall 16, via which the connecting part 3 of the housing is secured to the bracket 20, which carries the turbine 6. At the same time, the separator 8 is partially overlapped by the bracket 20, which rests upon a slightly convexly upwardly curved base 21' of an inner part 21 of the housing. Adjoining the base 21' is an upwardly extending wall 22 upon which the flange 18 of the connecting part 3 rests. On that side across or remote from the intake fitting 9, the base 21' adjoins the wall 3" of the connecting part 3. The cover part 2 has a pot-like configuration and surrounds the motor housing 5 and the top part 23 so as to be spaced therefrom; the part 23 in turn surrounds the motor housing 5 so as to be spaced therefrom. The cover part 2 extends to the intake fitting 9 and on the opposite side to about the level of the turbine 6. An outlet opening 24 is formed between the free edges of the housing wall 2' and of the housing wall 3' of the housing parts 2, 3. The top end 25 of the top part 23 extends perpendicular to the axis of the motor 4 and has an opening 26, below which is disposed a rotor 27, which is accommodated in the motor housing 5. The wall 23'0 of the top part 23 widens conically downwardly and has a radially outwardly extending circumferential rim 28 by means of which the top part 23 rests upon the middle part 29, which surrounds the upper part of the turbine 6 and is supported upon the wall 15 and flange 18 of the connecting part 3.

The middle part 29 has an upper, radially extending wall 30 that has an inner circumferential element 31 via which the middle part 21 rests against the turbine 6. The wall 30 merges with a downwardly extending wall 32, the free edge 30' of which rests upon the flange 18 of the connecting part 3. In the vicinity of the outlet opening 24, the free edge 30" is spaced slightly from the wall 15 of the connecting part 3, resulting in the formation of a passage 33 for the suction air stream P'. At about halfway along the width of the wall 30, an annular wall 34 extends downwardly and is approximately equally spaced from the wall 32 and from the turbine 6. On that side remote from the intake fitting 9, the annular wall 34 rests upon the wall 15, while in the vicinity of the intake fitting 9 the annular wall 34 rests upon the inner edge of the flange 18. In the vicinity of the intake fitting 9, the annular wall 34 has a radially inwardly projecting leg 35, 36 that has an L-shaped axial cross-sectional configuration; the upwardly projecting leg portion 36 is spaced from the turbine wall 6'. As a result, an opening 37, through which the air stream P' can flow, is formed between the leg portion 36 and the wall 6'.

Provided between the lower rim 10' of the lid 10 and the intake fitting 9 is a front orifice 38 that surrounds the intake fitting. On the underside of the motor housing 5, the coolant air flow P flows outwardly via the discharge openings 5' into an annular chamber 40 that is formed between the motor housing 5 and the top part 23; a pressure builds up in the coolant air flow P in the annular chamber 40. The coolant air flow P exits into an intermediate chamber 39 via a passage 41 that is provided in the wall 23' of the cup-shaped top part 23 and adjoins the top end thereof. From here, the coolant airflow P flows downwardly, through a flow-through gap 42 formed between the wall 32 of the top part 23 and the oppositely disposed housing wall 2', and into a downwardly adjoining turbulence chamber 43.

The walls 30 and 34, the legs 35, 36 and the turbine wall 6' delimit a first annular resonance chamber 48, which communicates via the opening 37 with a second resonance chamber 44 disposed therebelow. The sides of the second resonance chamber are delimited by the wall 17 and the turbine wall 6', while the top is delimited by the wall 15 and the leg portion 35. The base of the resonance chamber 44 is formed by the wall 16. The resonance chamber 44 has provided in its wall 17, next to the distributor head 13, an opening 49, which is, for example, round.

Adjoining the second resonance chamber 44 at the bottom is a third resonance chamber 45, which is delimited by the walls 17 and 22, the flange 18, the wall 16, and the base 21' of the inner housing part 21. Provided in the wall 16, below the distributor head 13, is an opening 46 through which the intake or suction air stream P' can flow. A fourth resonance chamber 47 is delimited by the housing walls 32, 34 of the middle part 29, the wall 30, and the flange 18 of the connecting part 3 or the housing wall 15. The resonance chamber 47 surrounds the resonance chamber 48 and is separated therefrom by the annular wall 34. As shown in FIGS. 1 and 2, the resonance chamber 47 is provided with the passage 33.

The coolant air flow P is drawn in by the rotor 27, which is fixedly seated on the motor shaft, via the front orifice 38 of the upper housing part 2. The coolant air flow P flows from the front orifice 38 into the intermediate chamber 39, in which it flows upwardly to the opening 26 in the top end 25 of the top part 23. The coolant air flow P then passes into the motor housing 5, in which the coolant air flow P flows downwardly along the motor 4, whereby the motor is optimally cooled. At the bottom end of the motor housing 5, the coolant air flow P exits via the discharge openings 5' into the annular chamber 40 between the motor housing 5 and the top part 3. The annular chamber 40 is embodied in such a way that the coolant air flow P, accompanied by increasing pressure, flows upwardly and via the passage 41 outwardly into the intermediate chamber 39. The coolant air flow P flows downwardly in the intermediate chamber 39' and enters via the flow-through gap 42 into the turbulence chamber 43.

The suction air stream P' is drawn in by means of the intake fitting 9 in a known manner. The suction air stream flows through the cleaning liquid F, in which the dust/dirt particles present in the drawn-in air are retained. The drawn-in air P' passes to the rotating separator 8, which along its periphery is provided with slits 50 through which the air flows. Dust/dirt particles that might still be present in the air are retained on or in the separator 8, so that clean air passes upwardly into the rotating turbine 6. By means of the discharge openings 7, the air stream P' passes into the resonance chamber 48, which encircles the vertical turbine axis. Its radially outer wall 34 advantageously comprises an elastic material, preferably rubber. As a result, already in this region vibrations of the air stream P' are dissipated or reduced, as a consequence of which the suction noises and the flow velocity of the air stream are reduced. The air stream P' is subsequently conducted through the annular gap 37 into the second resonance chamber 44, which encircles the vertical turbine axis. From there, the air stream P' passes via the opening 49 and/or the guiding or deflecting head 13 into the third resonance chamber 45, which similarly encircles the turbine axis. From the third resonance chamber, the air stream P' can flow via the apertures 19 in the flange 18 of the connecting part 3 into the fourth resonance chamber 47, which encircles the vertical motor axis. From the fourth resonance chamber the air stream P' passes via the passage 33 into the turbulence chamber 43, where the air stream P' intentionally meets the coolant air flow P, as a result of which noises of the two air streams as well as the air and suction noises thereof, are greatly reduced. As shown in FIG. 1, the coolant air flow P and the air stream P' meet from above and below in the turbulence chamber 43, resulting in an optimum noise attenuation. The two air streams P, P' preferably meet in the turbulence chamber 43 at right angles to one another. Depending upon the configuration, and/or requirement, the air streams P, P' can also meet one another in the turbulence chamber 43 at other angles. The two air streams P and P' are deflected such that they pass through the outlet opening 24 into the atmosphere. The flow velocities of the two air streams P, P' cancel one another or are so greatly reduced by the turbulence in the turbulence chamber 43 that upon discharge into the environment, no dust can any longer be raised from the floor.

The guiding or deflecting head 13 advantageously has an optimum flow configuration. It can also, as indicated in FIG. 1 by dashed lines, have an approximately conical configuration. The guiding or deflecting head 13 widens in a direction of flow in the direction toward the outlet opening 24. To optimize flow, the surface of the guiding or deflecting head 13 is concavely curved when viewed in an axial cross-section.

The middle housing part 29, which contains the resonance chambers 47 and 48, divides the upper housing part 2, 3, 29, 23 into a lower main portion having the housing connecting part 3, and an upper cover-like portion having the top part 23.

The outlet opening 24 of the turbulence chamber 43 is advantageously embodied such that the exiting air stream is deflected into a specific direction, preferably upwardly. For this purpose, the rim or rims or discharge edges of the outlet opening 24 are structurally embodied in such a way that they form deflection or guide surfaces at which the exiting air stream is deflected upwardly. This prevents the discharging air stream from unnecessarily raising dust particles in the immediate vicinity or on the floor. As shown in FIG. 1, the passage 43 for the air stream P' is disposed in the region below the bottom edge of the outlet opening 24. As a result, after passing through the passage 33 the air stream P' is necessarily deflected upwardly, so that it can pass out through the outlet opening 24.

Due to the described configuration of the successively disposed resonance chambers 44, 45, 47, 48 and the turbulence chamber 43, the air, suction, and discharge noises of the coolant air flow P and of the air stream P' are so greatly reduced that the wet cleaning apparatus operates with extremely little noise and without any significant raising of dust. Since the resonance chambers 44, 45 47, 48 have an annular configuration, long flow passages are available to the suction air P' and lead to a quieting and hence to a considerable reduction in noise.

The specification incorporates by reference the disclosure of German priority document 197 41 545.8 of Sep. 20, 1997.

The present invention is, of course, in no way restricted to the specific disclosure of the specification and drawings, but also encompasses any modifications within the scope of the appended claims.

What is claimed is:

1. A wet cleaning apparatus, said apparatus comprising:

a liquid container;

at least one opening for a drawn-in air stream, said drawn-in air stream transporting dirty air into said liquid container;

an intake fitting for said drawn-in air stream, said intake fitting opening out into said liquid container and adapted for attachment to an intake tube;

an upper housing part disposed on said liquid container and in which is disposed a motor about at least part of which flows a coolant air flow, said upper housing part being provided with at least one turbulence chamber, said opening leading into said turbulence chamber;

means for guiding said coolant air flow and said drawn-in air stream separately from one another in said wet cleaning apparatus, said drawn-in air stream and said coolant air flow conducted through housing walls in said turbulence chamber such that the drawn-in air stream and the coolant air flow meet at an angle relative to one another proximate to said opening to form a mixed air stream, said mixed air stream expelled upwardly from said apparatus through at least one outlet in said turbulence chamber.

2. A wet cleaning apparatus according to claim 1, wherein said means for guiding said coolant air flow and said drawn-in air stream is disposed in regions upstream of said turbulence chamber.

3. A wet cleaning apparatus according to claim 2, wherein in a direction of flow of said drawn-in air stream, at least one resonance chamber is disposed upstream of said turbulence chamber.

4. A wet cleaning apparatus according to claim 3, wherein first, second, third and fourth resonance chambers which are in flow communication with one another are provided in said wet cleaning apparatus for receiving said drawn-in air stream.

5. A wet cleaning apparatus according to claim 4, which includes a turbine, which is driven by said motor, said turbine having a housing that is provided with discharge openings that open into said first resonance chamber.

6. A wet cleaning apparatus according to claim 5, wherein said first resonance chamber is provided with at least one wall, against which said drawn-in air stream strikes upon leaving said discharge openings.

7. A wet cleaning apparatus according to claim 6, wherein said first resonance chamber is provided with at least one opening that opens into said second resonance chamber.

8. A wet cleaning apparatus according to claim 7, wherein said second resonance chamber has at least one opening.

9. A wet cleaning apparatus according to claim 8, wherein a guiding head is disposed downstream of said opening of said second resonance chamber.

10. A wet cleaning apparatus to claim 9, wherein said guiding head has a conical configuration.

11. A wet cleaning apparatus according to claim 9, wherein adjoining said second resonance chamber is said third resonance chamber, in which said guiding head is arranged.

12. A wet cleaning apparatus according to claim 11, wherein said third resonance chamber has at least one passage that connects said third resonance chamber with said fourth resonance chamber.

13. A wet cleaning apparatus according to claim 12, wherein said fourth resonance chamber is disposed radially adjacent said first resonance chamber.

14. A wet cleaning apparatus according to claim 13, wherein said first and said fourth resonance chambers are separated from one another by a wall of said first resonance chamber.

15. A wet cleaning apparatus according to claim 14, each of said resonance chambers have an annular configuration.

16. A wet cleaning apparatus according to claim 15, wherein said resonance chambers have a common axis.

17. A wet cleaning apparatus according to claim 12, wherein said upper housing part includes a middle housing part that is disposed between a connecting housing part and a top housing part thereof, and wherein said first and said fourth resonance chambers are provided in said middle housing part.

18. A wet cleaning apparatus according to claim 17, wherein said middle housing part surrounds and is spaced from said turbine.

19. A wet cleaning apparatus according to claim 17, wherein said motor has a motor housing with at least one discharge opening that opens into an annular chamber formed between said motor housing and said top housing part.

20. A wet cleaning apparatus according to claim 19, wherein said annular chamber is provided in its radial outer wall with at least one passage for the coolant air flow so that said coolant air flow can flow from said annular chamber into a flow chamber formed between said top housing part and a housing cover part of said upper housing part.

21. A wet cleaning apparatus according to claim 19, wherein said annular chamber disposed at a connection region of said top housing part to said middle housing part, is provided with at least one flow-through opening that opens into said turbulence chamber.

22. A wet cleaning apparatus according to claim 21, wherein said flow-through opening, which is for said coolant air flow, is disposed opposite a discharge opening for said drawn-in air stream.

23. A wet cleaning apparatus according to claim 17, wherein said middle-housing part has an annular configuration.

24. A wet cleaning apparatus according to claim 12, wherein said fourth resonance chamber has at least one passage that opens into said turbulence chamber.

25. A wet cleaning apparatus according to claim 24, wherein said passage of said fourth resonance chamber is disposed in the region of a base thereof.

26. A wet cleaning apparatus according to claim 24, wherein said outlet of said turbulence chamber is disposed in the region above said passage of said fourth resonance chamber.

27. A wet cleaning apparatus according to claim 12, wherein said first and said fourth resonance chambers are of approximately the same size.

28. A wet cleaning apparatus according to claim 12, wherein said third resonance chamber includes several passages that connect said third resonance chamber with said fourth resonance chamber.

29. A wet cleaning apparatus according to claim 8, wherein said opening extends over the entire height of said second resonance chamber.

30. A wet cleaning apparatus according to claim 6, wherein said at least one wall is made of elastic material.

31. A wet cleaning apparatus according to claim 1, wherein said outlet of said turbulence chamber is provided with at least one edge that is embodied as a deflection member.

32. A wet cleaning apparatus said apparatus comprising:

a liquid container;

an intake fitting for a drawn-in air stream which opens out into said liquid container;

an upper housing part disposed on said liquid container and in which is disposed a motor about at least part of which flows a coolant air flow, said upper housing part being provided with at least one turbulence chamber in which said drawn-in air stream and said coolant air flow meet one another at an angle relative to one another, to form a mixed air stream, said mixed air stream expelled upwardly from said apparatus through an outlet in said turbulence chamber.

* * * * *